US008496500B1

(12) United States Patent
Wu

(10) Patent No.: US 8,496,500 B1
(45) Date of Patent: Jul. 30, 2013

(54) TERMINAL HOLDER STRUCTURE FOR RJ45 DUAL-PORT JACK

(75) Inventor: Fu-Wen Wu, Keelung (TW)

(73) Assignee: Telebox Industries Corp., New Taipei (TW)

( * ) Notice: Subject to any disclaimer, the term of this patent is extended or adjusted under 35 U.S.C. 154(b) by 72 days.

(21) Appl. No.: 13/372,809

(22) Filed: Feb. 14, 2012

(51) Int. Cl.
*H01R 24/00* (2011.01)

(52) U.S. Cl.
USPC ..... 439/676; 439/638

(58) Field of Classification Search
USPC ..... 439/676, 638
See application file for complete search history.

(56) References Cited

U.S. PATENT DOCUMENTS 4,817,283 A * 4/1989 Johnston et al. ..... 29/884
6,383,028 B1 * 5/2002 Chang ..... 439/638
6,964,585 B2 * 11/2005 Blichasz et al. ..... 439/638
7,824,232 B2 * 11/2010 Daly et al. ..... 439/676

* cited by examiner

*Primary Examiner* — Hien Vu
(74) *Attorney, Agent, or Firm* — Jackson IPG PLLC

(57) ABSTRACT

A terminal holder structure installed in a RJ45 dual-port jack is disclosed to include a plastic intermediate bracket mounted on a middle part of a circuit board to hold the $3^{rd}$ and $5^{th}$ terminals of a first set of terminals numbered from $1^{st}$ through $8^{th}$ and the $3^{rd}$ and $5^{th}$ terminals of a second set of terminals numbered from $1^{st}$ through $8^{th}$ in reversed directions so that the distance' between the $3^{rd}$ and $5^{th}$ terminals of the first set of terminals and the $3^{rd}$ and $5^{th}$ terminals of the second set of terminals is extended for crosstalk compensation to avoid crosstalk interference in the RJ45 dual-port jack.

11 Claims, 8 Drawing Sheets

TERMINAL HOLDER STRUCTURE FOR RJ45 DUAL-PORT JACK

BACKGROUND AND SUMMARY OF THE INVENTION

The present invention relates to RJ45 dual-port jack technology and more particularly, to a terminal holder structure for RJ45 dual-port jack has an intermediate bracket arranged on the middle part of the top wall of the circuit board thereof to hold the $3^{rd}$ and $5^{th}$ terminals of the first and second sets of terminals in a back to back manner so that the distance between the $3^{rd}$ and $5^{th}$ terminals of the first set of terminals and the $3^{rd}$ and $5^{th}$ terminals of the second set of terminals is sufficient for crosstalk compensation, avoiding crosstalk interference and improving communication quality.

A conventional RJ45 dual-port jack, as shown in FIG. 1, generally comprises an insulative housing (not shown) and a terminal holder structure A mounted in the housing. The terminal holder structure A comprises a circuit board B, a first set of terminals 81, 82, 83, 84, 85, 86, 87, 88 numbered from $1^{st}$ through $8^{th}$, a second set of terminals 91, 92, 93, 94, 95, 96, 97, 98 numbered from $1^{st}$ through $8^{th}$, a first bracket 80, and a second bracket 90. The first set of terminals 81, 82, 83, 84, 85, 86, 87, 88 is mounted at the first bracket 80 and then installed with the first bracket 80 in the front side of the circuit board B. The second set of terminals 91, 92, 93, 94, 95, 96, 97, 98 is mounted at the second bracket 90 and then installed with the second bracket 90 in the rear side of the circuit board B. However, in the aforesaid design, the distance D between the two sets of third and fifth terminals 83,85; 93,95 (see FIGS. 2 and 3) is too short, or about 1.85 mm (RJ45 Center 2 Pair 3/5 Pin distance 1.85/mm) not sufficient for crosstalk compensation, causing a phase delay and inductive effects of metal wiring. In consequence, a serious crosstalk will occur across the area around the two sets of third and fifth terminals 83,85; 93,95 (RJ45 Center Pair 3/5 Pin).

The present invention has been accomplished under the circumstances in view. It is therefore the main object of the present invention to provide a terminal holder structure for RJ45 dual-port jack, which enables the distance between the $3^{rd}$ and $5^{th}$ terminals of the first set of terminals and the $3^{rd}$ and $5^{th}$ terminals of the second set of terminals be extended for crosstalk compensation, avoiding crosstalk interference and improving communication quality.

To achieve this and other objects of the present invention, a terminal holder structure is installed in an electrically insulative housing of a RJ45 dual-port jack, comprising a circuit board, a first set of terminals numbered from $1^{st}$ through $8^{th}$, a second set of terminals numbered from $1^{st}$ through $8^{th}$, at least one first bracket located on the circuit board at a front side and holding the $1^{st}$, $2^{nd}$, $4^{th}$, $6^{th}$, $7^{th}$ and $8^{th}$ terminals of the first set of terminals in a parallel manner, and at least one second bracket located on the circuit board at a rear side and holding the $1^{st}$, $2^{nd}$, $4^{th}$, $6^{th}$, $7^{th}$ and $8^{th}$ terminals of the second set of terminals in a parallel manner, wherein the terminal holder structure further comprises at least one plastic intermediate bracket arranged at a middle part of the circuit board between the at least one first bracket and the at least one second bracket to hold the $3^{rd}$ and $5^{th}$ terminals of the first set of terminals and the $3^{rd}$ and $5^{th}$ terminals of the second set of terminals in reversed directions so that the distance' between the $3^{rd}$ and $5^{th}$ terminals of the first set of terminals and the $3^{rd}$ and $5^{th}$ terminals of the second set of terminals is extended for crosstalk compensation to avoid crosstalk interference in the RJ45 dual-port jack; the $3^{rd}$ and $5^{th}$ terminals of the first set of terminals are arranged to face toward a front side of the circuit board so that respective front contact portions of the $3^{rd}$ and $5^{th}$ terminals of the first set of terminals are respectively suspending between respective front contact portions of the $4^{th}$ and $6^{th}$ terminals of the first set of terminals; the $3^{rd}$ and $5^{th}$ terminals of the second set of terminals are arranged to face toward a rear side of the circuit board so that respective front contact portions of the $3^{rd}$ and $5^{th}$ terminals of the second set of terminals are respectively suspending between respective front contact portions of the $4^{th}$ and $6^{th}$ terminals of the second set of terminals.

DETAILED DESCRIPTION OF THE INVENTION

Figure 7:
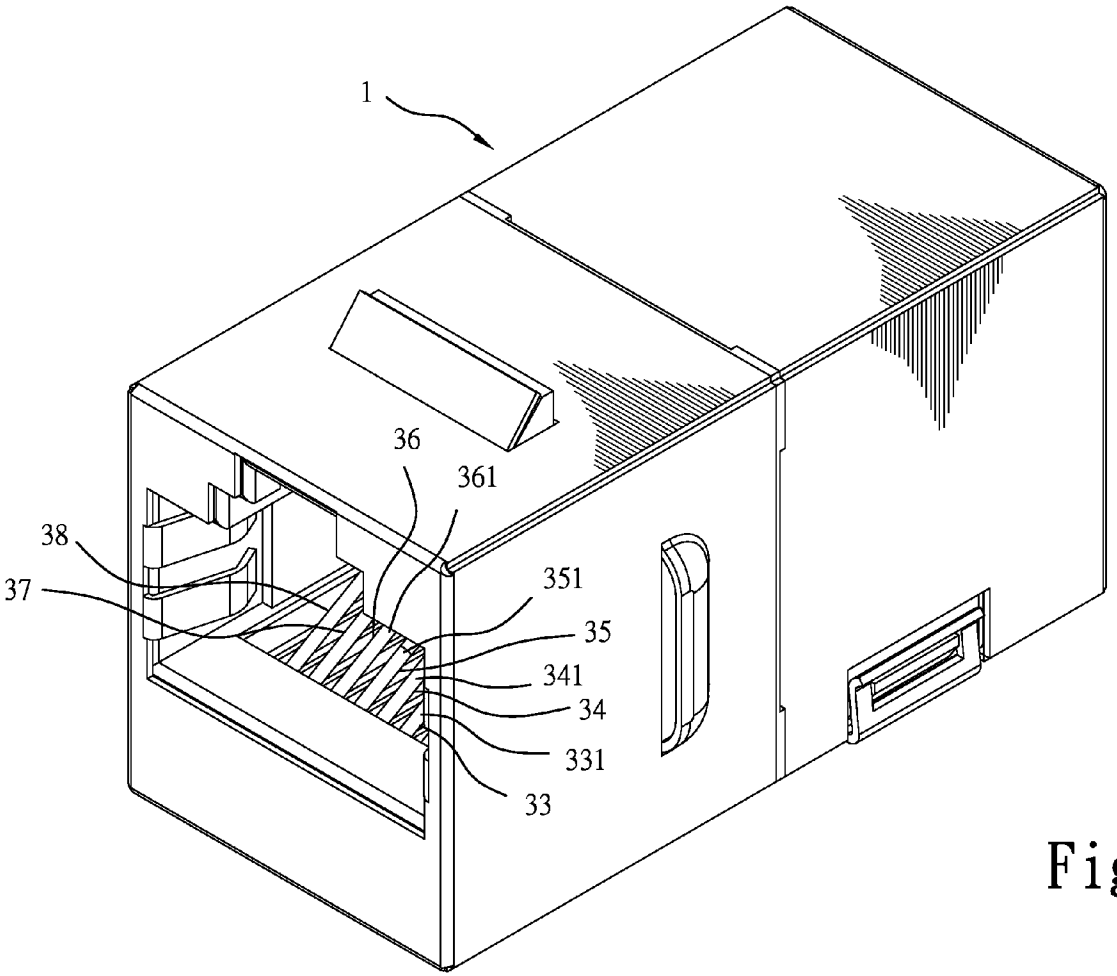
FIG. 7 is an elevational view of a RJ45 dual-port jack constructed according to the present invention.
Figure 8:
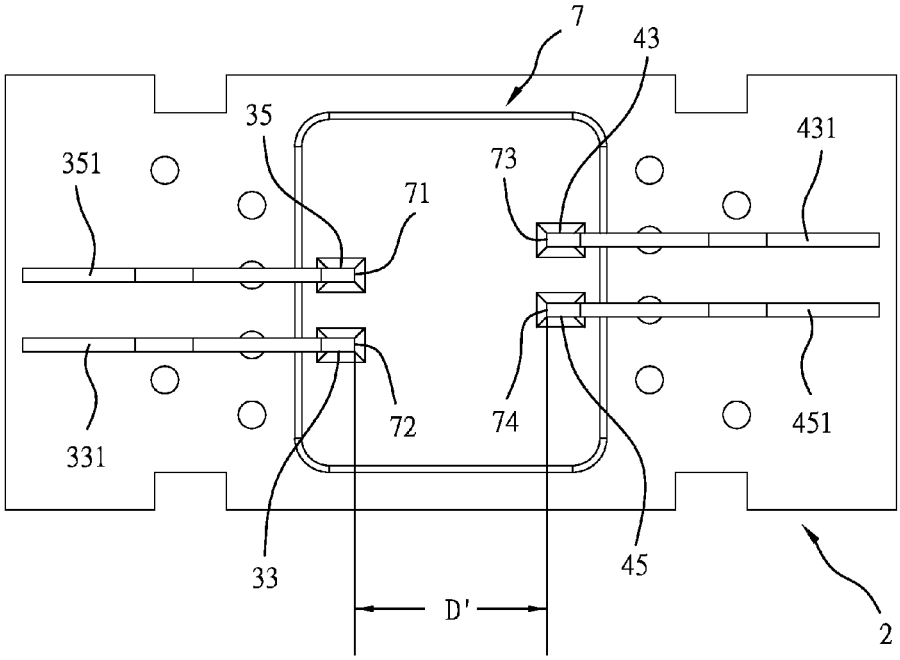
FIG. 8 is a schematic top plain view of the first embodiment of the present invention, illustrating the arrangement of the 3rd and $5^{th}$ terminals of the first and second sets of terminals.
Figure 9:
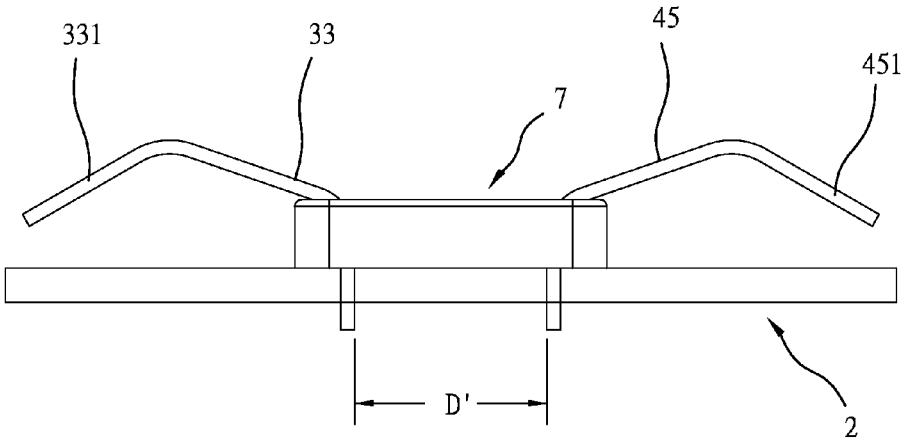
FIG. 9 is a schematic side plain view of the first embodiment of the present invention, illustrating the distance between the 3rd and $5^{th}$ terminals of the first and second sets of terminals.

Referring to FIGS. 4 through 9, a terminal holder structure in accordance with a first embodiment is shown mounted in an electrically insulative housing 1 of a RJ45 dual-port jack (see FIG. 7). The terminal holder structure comprises a circuit board 2, a first set of terminals 31, 32, 33, 34, 35, 36, 37, 38 numbered from $1^{st}$ through $8^{th}$, a second set of terminals 41, 42, 43, 44, 45, 46, 47, 48 numbered from $1^{st}$ through $8^{th}$, at least one first bracket 5 located on the top wall of the circuit board 2 at a front side and holding the $1^{st}$, $2^{nd}$, $4^{th}$, $6^{th}$, $7^{th}$ and $8^{th}$ terminals of the first set of terminals 31, 32, 33, 34, 35, 36, 37, 38 in a parallel manner, and at least one second bracket 6 located on the top wall of the circuit board 2 at a rear side and holding the $1^{st}$, $2^{nd}$, $4^{th}$, $6^{th}$, $7^{th}$ and $8^{th}$ terminals of the second set of terminals 41, 42, 43, 44, 45, 46, 47, 48 in a parallel manner.

The main feature of the present invention is outlined hereinafter.

A plastic intermediate bracket 7 is arranged at the top wall of the circuit board 2 on the middle between the at least one first bracket 5 and the at least one second bracket 6, holding the $3^{rd}$ and $5^{th}$ terminals 33 and 35 of the first set of terminals 31, 32, 33, 34, 35, 36, 37, 38 in a spaced manner in the front side thereof and the $3^{rd}$ and $5^{th}$ terminals 43 and 45 of the second set of terminals 41, 42, 43, 44, 45, 46, 47, 48 in a spaced manner in the rear side thereof. Thus, the distance D' between the $3^{rd}$ and $5^{th}$ terminals 33 and 35 of the first set of terminals 31, 32, 33, 34, 35, 36, 37, 38 and the $3^{rd}$ and $5^{th}$ terminals 43 and 45 of the second set of terminals 41, 42, 43, 44, 45, 46, 47, 48 (see FIGS. 8 and 9) is sufficient (about 5.94 mm) for crosstalk compensation, avoiding crosstalk interference and improving communication quality.

Further, the $3^{rd}$ and $5^{th}$ terminals 33 and 35 of the first set of terminals 31, 32, 33, 34, 35, 36, 37, 38 are arranged to face toward the front side of the circuit board 2 so that the front contact portions 331 and 351 of the $3^{rd}$ and $5^{th}$ terminals 33 and 35 of the first set of terminals 31, 32, 33, 34, 35, 36, 37, 38 are respectively suspending between the front contact portions 341 and 361 of the $4^{th}$ and $6^{th}$ terminals 34 and 36 of the first set of terminals 31, 32, 33, 34, 35, 36, 37, 38. Further, the $3^{rd}$ and $5^{th}$ terminals 43 and 45 of the second set of terminals 41-48 are arranged to face toward the rear side of the circuit board 2 so that the front contact portions 431 and 451 of the $3^{rd}$ and $5^{th}$ terminals 43 and 45 of the second set of terminals 41, 42, 43, 44, 45, 46, 47, 48 are respectively suspending between the front contact portions 441 and 461 of the $4^{th}$ and $6^{th}$ terminals 44 and 46 of the second set of terminals 41, 42, 43, 44, 45, 46, 47, 48.

Figure 4:
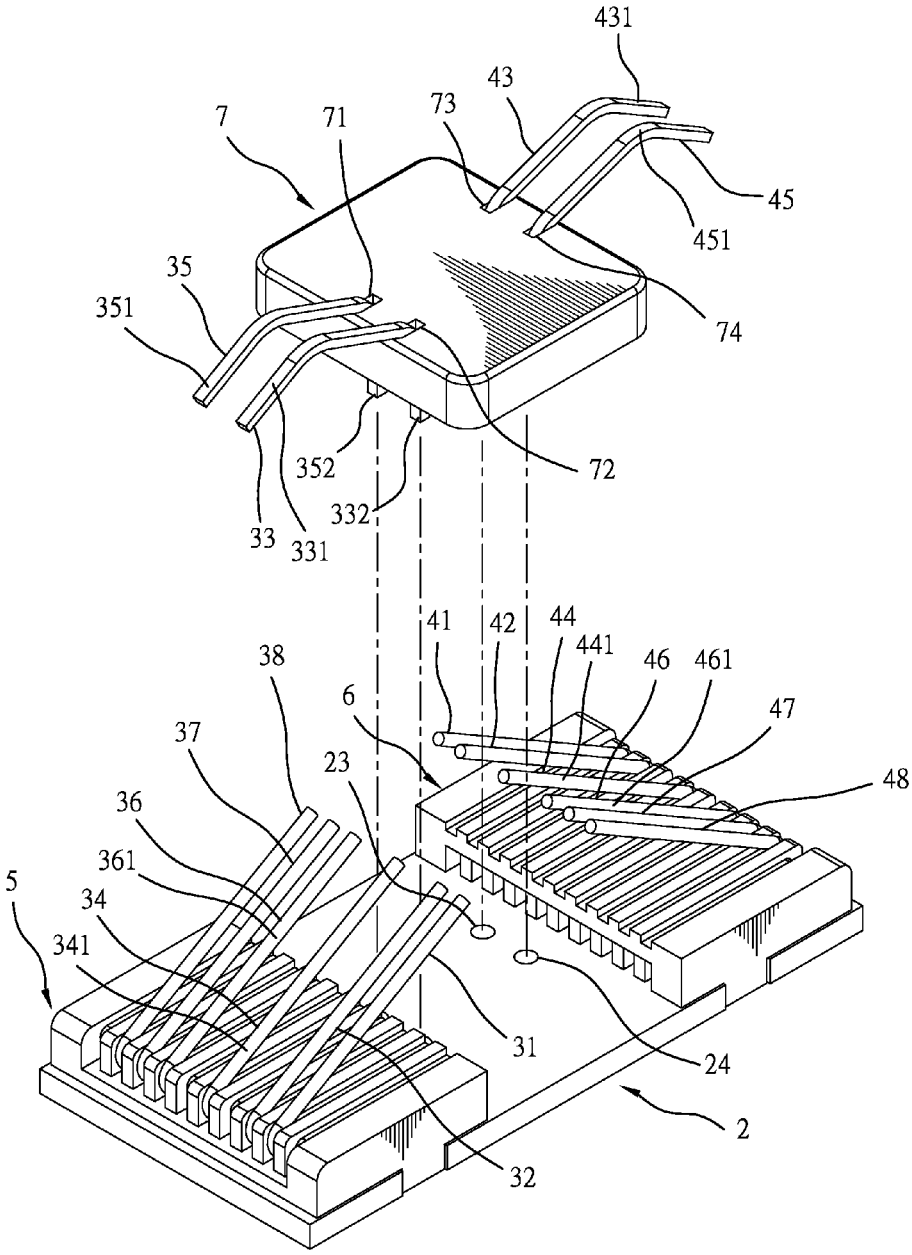
FIG. 4 is an exploded view of a terminal holder structure for RJ45 dual-port jack in accordance with a first embodiment of the present invention.
Figure 5:
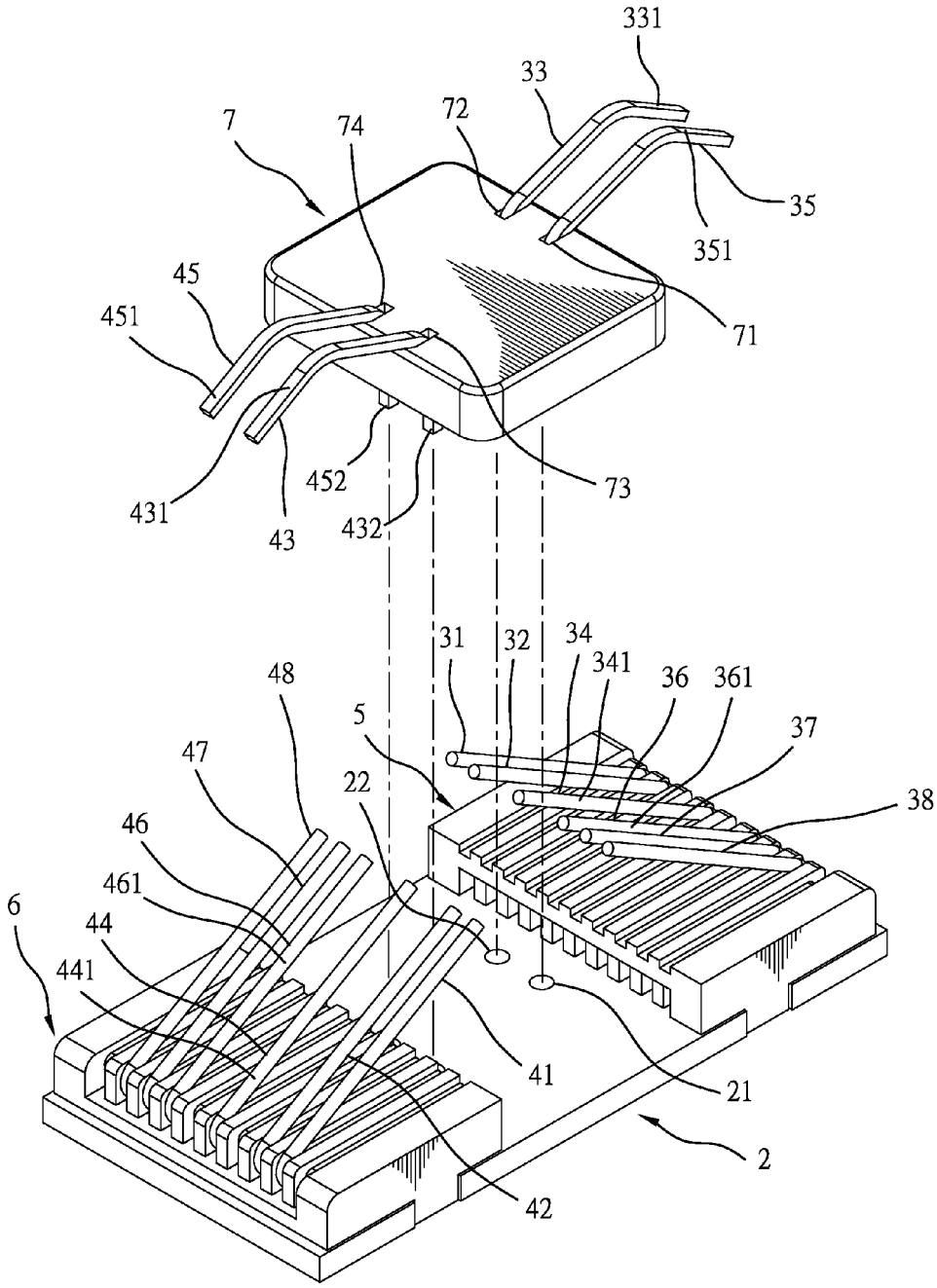
FIG. 5 corresponds to FIG. 4 when viewed from another angle.
Figure 6:
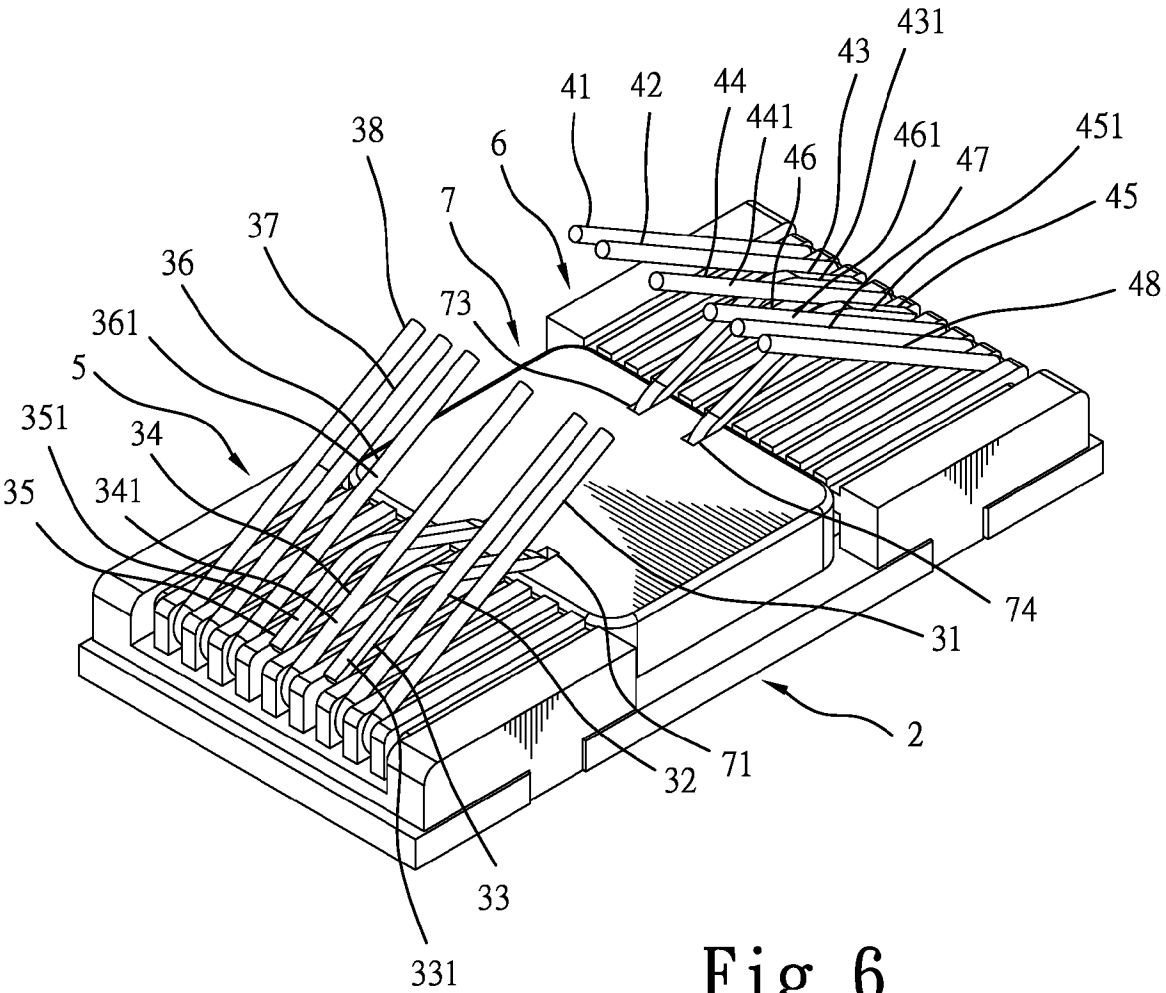
FIG. 6 is an elevational assembly view of FIG. 4.

Further, the circuit board 2 comprises four via holes 21, 22, 23 and 24 (see FIGS. 4 and 5). The rear bonding portions 332 and 352 of the $3^{rd}$ and $5^{th}$ terminals 33 and 35 of the first set of terminals 31, 32, 33, 34, 35, 36, 37, 38 and the rear bonding portions 432 and 452 of the $3^{rd}$ and $5^{th}$ terminals 43 and 45 of the second set of terminals 41, 42, 43, 44, 45, 46, 47, 48 are respectively electrically bonded to the via holes 21, 22, 23 and 24 of the circuit board 2.

Further, the plastic intermediate bracket 7 comprises four terminal slots 71, 72, 73 and 74 arranged in two symmetrical pairs and cut through the top and bottom walls thereof. The $3^{rd}$ and $5^{th}$ terminals 33 and 35 of the first set of terminals 31-18 and the $3^{rd}$ and $5^{th}$ terminals 43 and 45 of the second set of terminals 41, 42, 43, 44, 45, 46, 47, 48 are respectively inserted through the terminal slots 71, 72, 73 and 74 of the plastic intermediate bracket 7.

Figure 10:
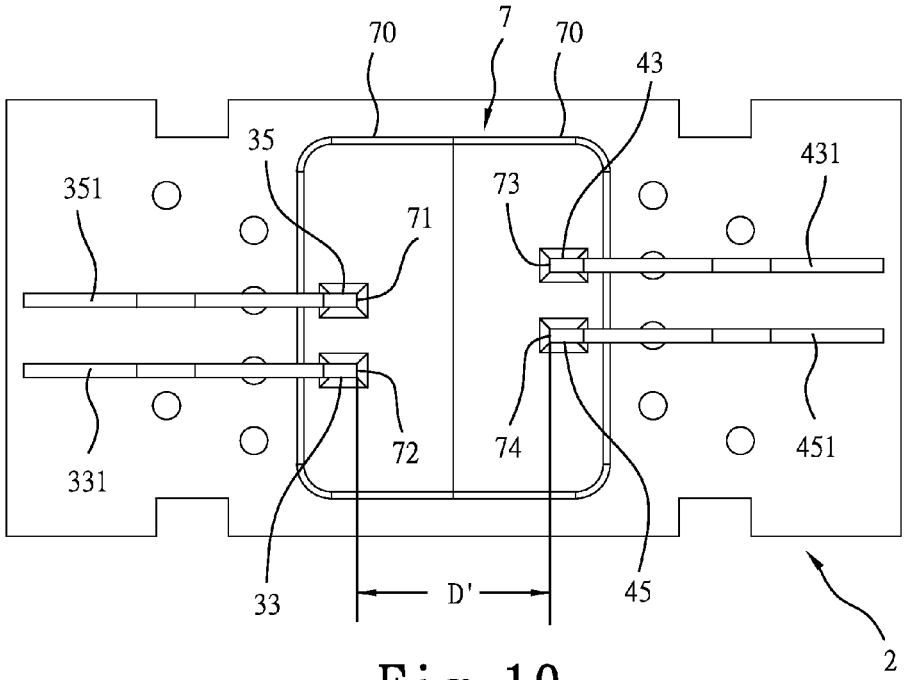
FIG. 10 is a schematic top view of a terminal holder structure for RJ45 dual-port jack in accordance with a second embodiment of the present invention.

FIG. 10 illustrates a terminal holder structure for RJ45 dual-port jack in accordance with a second embodiment of the present invention. This second embodiment is substantially similar to the aforesaid first embodiment with the exception that the plastic intermediate bracket 7 is formed of two intermediate sub brackets 70 that are abutted against each other, wherein one intermediate sub bracket 70 holds the $3^{rd}$ and $5^{th}$ terminals 33 and 35 of the first set of terminals in a spaced manner and the other intermediate sub bracket 70 holds the $3^{rd}$ and $5^{th}$ terminals 43 and 45 of the second set of terminals in a spaced manner. Thus, the distance D' between the $3^{rd}$ and $5^{th}$ terminals 33 and 35 of the first set of terminals and the $3^{rd}$ and $5^{th}$ terminals 43 and 45 of the second set of terminals is sufficient for crosstalk compensation, avoiding crosstalk interference and improving communication quality.

Further, the $3^{rd}$ and $5^{th}$ terminals 33 and 35 of the first set of terminals are arranged to face toward the front side of the circuit board 2 so that the front contact portions 331 and 351 of the $3^{rd}$ and $5^{th}$ terminals 33 and 35 of the first set of terminals are respectively suspending between the front contact portions of the $4^{th}$ and $6^{th}$ terminals (not shown) of the first set of terminals. Further, the $3^{rd}$ and $5^{th}$ terminals 43 and 45 of the second set of terminals are arranged to face toward the rear side of the circuit board 2 so that the front contact portions 431 and 451 of the $3^{rd}$ and $5^{th}$ terminals 43 and 45 of the second set of terminals are respectively suspending between the front contact portions of the $4^{th}$ and $6^{th}$ terminals (not shown) of the second set of terminals.

Further, the circuit board 2 comprises four via holes (not shown). The rear bonding portions 332 and 352 of the $3^{rd}$ and $5^{th}$ terminals 33 and 35 of the first set of terminals and the rear bonding portions 432 and 452 of the $3^{rd}$ and $5^{th}$ terminals 43 and 45 of the second set of terminals are respectively electrically bonded to the via holes of the circuit board 2.

Further, the two intermediate sub brackets 70 of the plastic intermediate bracket 7 each comprise two terminal slots 71 and 72; 73 and 74 respectively cut through the top and bottom walls thereof. The $3^{rd}$ and $5^{th}$ terminals 33 and 35 of the first set of terminals and the $3^{rd}$ and $5^{th}$ terminals 43 and 45 of the second set of terminals are respectively inserted through the terminal slots 71 and 72; 73 and 74 of the two intermediate sub brackets 70 of the plastic intermediate bracket 7.

Figure 11:
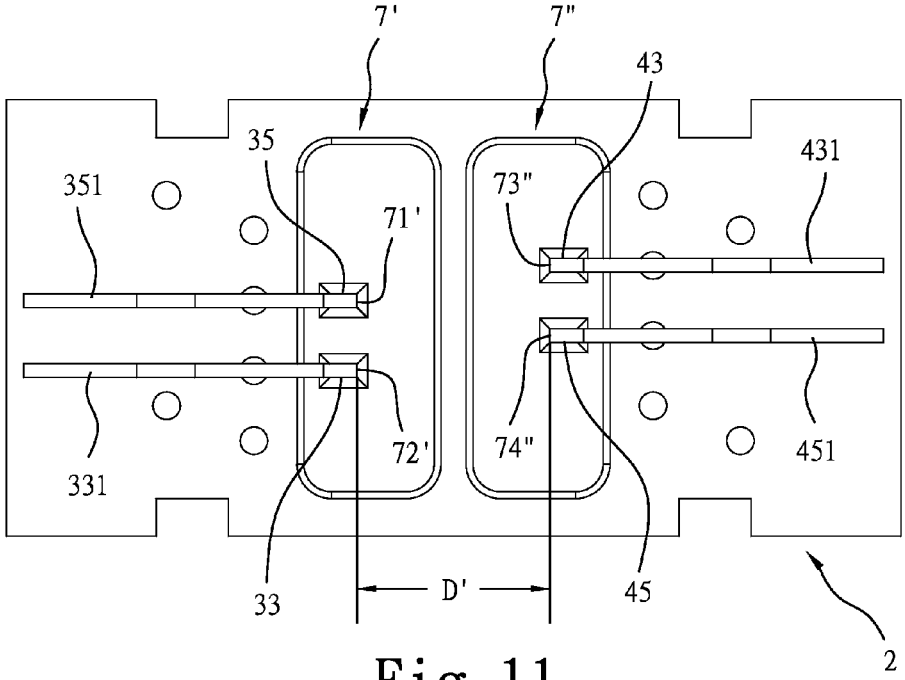
FIG. 11 is a schematic top view of a terminal holder structure for RJ45 dual-port jack in accordance with a third embodiment of the present invention.

FIG. 11 illustrates a terminal holder structure for RJ45 dual-port jack in accordance with a third embodiment of the present invention. This third embodiment is substantially similar to the aforesaid first embodiment with the exception that two plastic intermediate brackets 7' and 7" are arranged on the middle part of the top wall of the circuit board 2 and kept apart at a distance, wherein one intermediate bracket 7' holds the $3^{rd}$ and $5^{th}$ terminals 33 and 35 of the first set of terminals in a spaced manner and the other intermediate bracket 7" holds the $3^{rd}$ and $5^{th}$ terminals 43 and 45 of the second set of terminals in a spaced manner. Thus, the distance D' between the $3^{rd}$ and $5^{th}$ terminals 33 and 35 of the first set of terminals and the $3^{rd}$ and $5^{th}$ terminals 43 and 45 of the second set of terminals is sufficient for crosstalk compensation, avoiding crosstalk interference and improving communication quality.

Further, the $3^{rd}$ and $5^{th}$ terminals 33 and 35 of the first set of terminals are arranged to face toward the front side of the circuit board 2 so that the front contact portions 331 and 351 of the $3^{rd}$ and $5^{th}$ terminals 33 and 35 of the first set of terminals are respectively suspending between the front contact portions of the $4^{th}$ and $6^{th}$ terminals (not shown) of the first set of terminals. Further, the $3^{rd}$ and $5^{th}$ terminals 43 and 45 of the second set of terminals are arranged to face toward the rear side of the circuit board 2 so that the front contact portions 431 and 451 of the $3^{rd}$ and $5^{th}$ terminals 43 and 45 of the second set of terminals are respectively suspending between the front contact portions of the $4^{th}$ and $6^{th}$ terminals (not shown) of the second set of terminals.

Further, the circuit board 2 comprises four via holes (not shown). The rear bonding portions 332 and 352 of the $3^{rd}$ and $5^{th}$ terminals 33 and 35 of the first set of terminals and the rear bonding portions 432 and 452 of the $3^{rd}$ and $5^{th}$ terminals 43 and 45 of the second set of terminals are respectively electrically bonded to the via holes of the circuit board 2.

Further, the two intermediate brackets 7' and 7" each comprise two terminal slots 71' and 72'; 73" and 74" respectively cut through the top and bottom walls thereof. The $3^{rd}$ and $5^{th}$ terminals 33 and 35 of the first set of terminals and the $3^{rd}$ and $5^{th}$ terminals 43 and 45 of the second set of terminals are respectively inserted through the terminal slots 71' and 72'; 73" and 74" of the two intermediate brackets 7' and 7".

Figure 1:
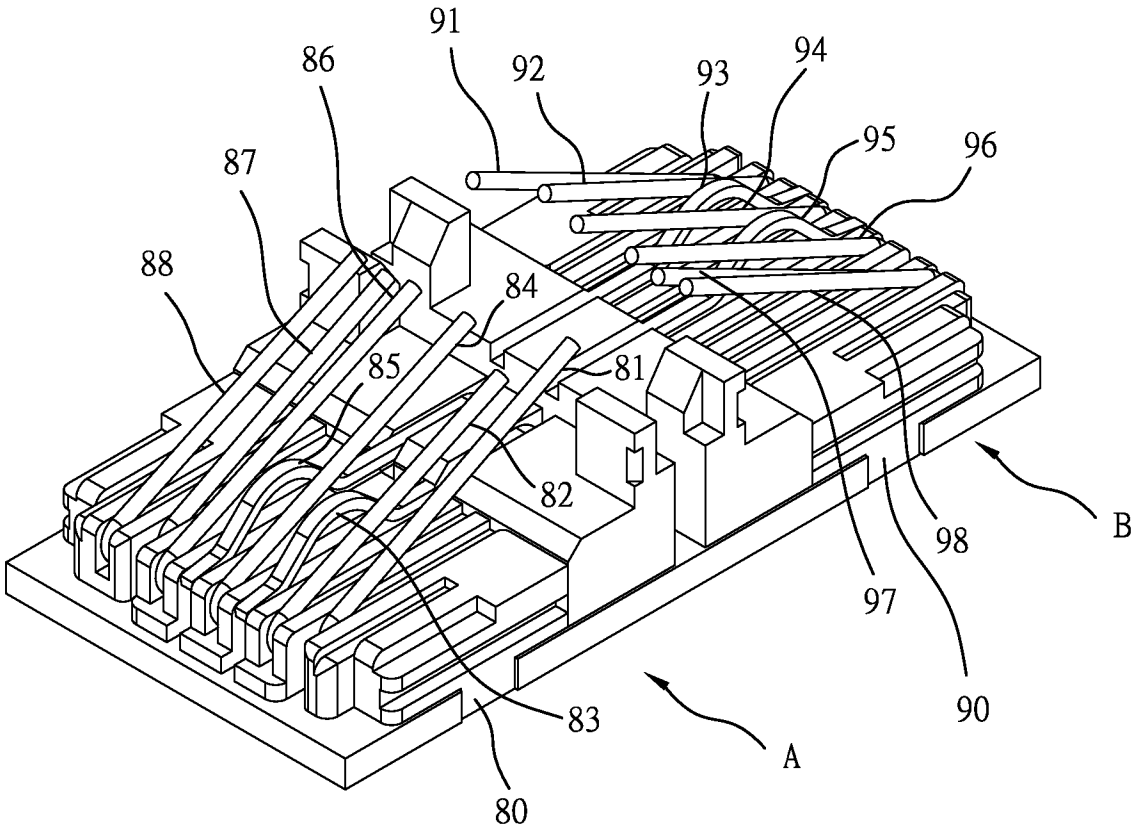
Fig. 1 PRIOR ART
FIG. 1 is an elevational view of a terminal holder structure for RJ45 dual-port jack according to the prior art.
Figure 2:
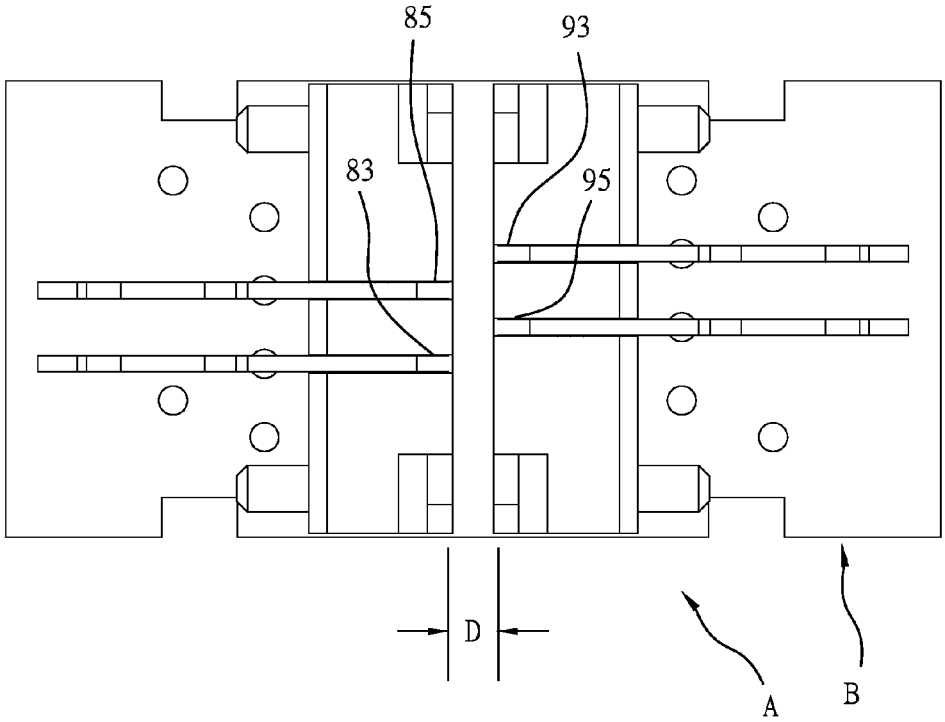
Fig. 2 PRIOR ART
FIG. 2 is a schematic top plain view of the prior art design, illustrating the arrangement of the 3rd and $5^{th}$ terminals of the first and second sets of terminals.
Figure 3:
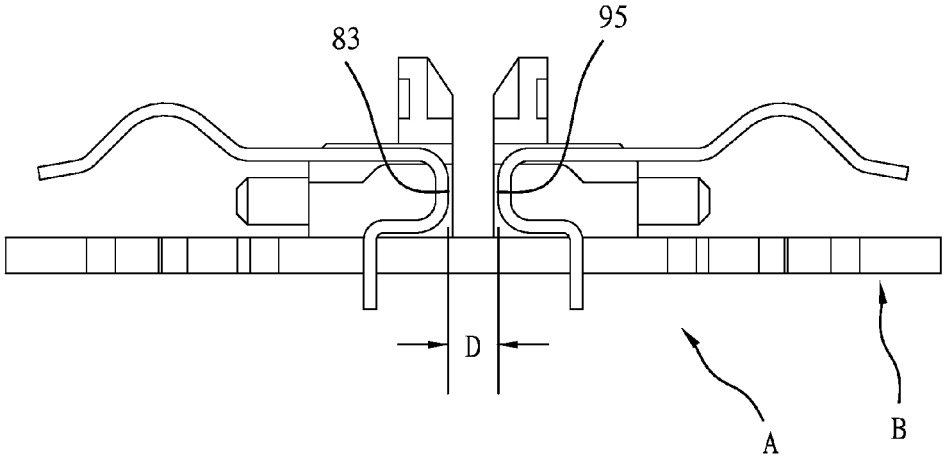
Fig. 3 PRIOR ART
FIG. 3 is a schematic side plain view of the prior art design, illustrating the distance between the 3rd and $5^{th}$ terminals of the first and second sets of terminals.

In conclusion, the invention provides a terminal holder structure for RJ45 dual-port jack, which has the advantages and features as follows:

1. The terminal holder structure for RJ45 dual-port jack has an intermediate bracket 7 arranged on the middle part of the top wall of the circuit board 2 thereof to hold the $3^{rd}$ and $5^{th}$ terminals 33 and 35; 43 and 45 of the first and second sets of terminals (2 Pair 3/5 Pin) in a back to back manner so that the distance D' between the $3^{rd}$ and $5^{th}$ terminals 33 and 35 of the first set of terminals 31, 32, 33, 34, 35, 36, 37, 38 and the $3^{rd}$ and $5^{th}$ terminals 43 and 45 of the second set of terminals 41, 42, 43, 44, 45, 46, 47, 48 (see FIGS. 8 and 9) is sufficient (about 5.94 mm, which is much wider than the distance D of 1.85 mm in the prior art design shown in FIG. 1) for crosstalk compensation, avoiding crosstalk interference and improving communication quality. When used in a 10G Ethernet network in the frequency range 1 MHz to 500 MHz, a different geometric position of metal can change the coupling phenomenon of surrounding metals, thereby indirectly affecting alteration of asymmetric phase retardation and increasing or decreasing of crosstalk vector in device crosstalk interference. In other words, the arrangement of the intermediate bracket 7 on the circuit board 2 can compensate for crosstalk loop space, effectively reducing crosstalk interference in the RJ45 dual-port jack.

2. The curved configuration of the $3^{rd}$ and $5^{th}$ terminals 33 and 35 of the first set of terminals 31, 32, 33, 34, 35, 36, 37, 38 and the $3^{rd}$ and $5^{th}$ terminals 43 and 45 of the second set of terminals 41, 42, 43, 44, 45, 46, 47, 48 that are supported on the intermediate bracket 7 facilitates interaction between metal wires to generate a capacitive effect.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A terminal holder structure installed in an electrically insulative housing of a RJ45 dual-port jack, comprising a circuit board, a first set of terminals numbered from 1st through 8th, a second set of terminals numbered from 1st through 8th, at least one first bracket located on said circuit board at a front side and holding the 1st, 2nd, 4th, 6th, 7th and 8th terminals of said first set of terminals in a parallel manner, and at least one second bracket located on said circuit board at a rear side and holding the 1st, 2nd, 4th, 6th, 7th and 8th terminals of said second set of terminals in a parallel manner;

wherein the terminal holder structure further comprises a plastic intermediate bracket arranged at a middle part of said circuit board between said at least one first bracket and said at least one second bracket to hold the 3rd and 5th terminals of said first set of terminals in a spaced manner in a front side thereof and the 3rd and 5th terminals of said second set of terminals in a spaced manner in a rear side thereof so that a distance between the 3rd and 5th terminals of said first set of terminals and the 3rd and 5th terminals of said second set of terminals is extended for crosstalk compensation to avoid crosstalk interference in said RJ45 dual-port jack; and wherein said plastic intermediate bracket comprises four terminal slots arranged in two symmetrical pairs and cut through opposing top and bottom walls thereof; the 3rd and 5th terminals of said first set of terminals and the 3rd and 5th terminals of said second set of terminals are respectively inserted through the terminal slots of said plastic intermediate bracket and electrically bonded to said circuit board.

2. The terminal holder structure as claimed in claim 1, wherein the $3^{rd}$ and $5^{th}$ terminals of said first set of terminals are arranged to face toward a front side of said circuit board so that respective front contact portions of the $3^{rd}$ and $5^{th}$ terminals of said first set of terminals are respectively suspending between respective front contact portions of the $4^{th}$ and $6^{th}$ terminals of said first set of terminals; the $3^{rd}$ and $5^{th}$ terminals of said second set of terminals are arranged to face toward a rear side of said circuit board so that respective front contact portions of the $3^{rd}$ and $5^{th}$ terminals of said second set of terminals are respectively suspending between respective front contact portions of the $4^{th}$ and $6^{th}$ terminals of said second set of terminals.

3. The terminal holder structure as claimed in claim 1, wherein said circuit board comprises four via holes; the $3^{rd}$ and $5^{th}$ terminals of said first set of terminals and the $3^{rd}$ and $5^{th}$ terminals of said second set of terminals have respective rear bonding portions thereof respectively electrically bonded to the via holes of said circuit board.

4. The terminal holder structure as claimed in claim 1, wherein said plastic intermediate bracket is a single piece member.

5. The terminal holder structure as claimed in claim 1, wherein said plastic intermediate bracket is formed of a plurality of sub brackets.

6. A terminal holder structure installed in an electrically insulative housing of a RJ45 dual-port jack, comprising a circuit board, a first set of terminals numbered from 1st through 8th, a second set of terminals numbered from 1st through 8th, at least one first bracket located on said circuit board at a front side and holding the 1st, 2nd, 4th, 6th, 7th and 8th terminals of said first set of terminals in a parallel manner, and at least one second bracket located on said circuit board at a rear side and holding the 1st, 2nd, 4th, 6th, 7th and 8th terminals of said second set of terminals in a parallel manner;

wherein the terminal holder structure further comprises a plastic intermediate bracket arranged at a middle part of said circuit board between said at least one first bracket and said at least one second bracket to hold the 3rd and 5th terminals of said first set of terminals in a spaced manner in a front side thereof and the 3rd and 5th terminals of said second set of terminals in a spaced manner in a rear side thereof so that a distance between the 3rd and 5th terminals of said first set of terminals and the 3rd and 5th terminals of said second set of terminals is extended for crosstalk compensation to avoid crosstalk interference in said RJ45 dual-port jack; the 3rd and 5th terminals of said first set of terminals are arranged to face toward a front side of said circuit board so that respective front contact portions of the 3rd and 5th terminals of said first set of terminals are respectively suspending between respective front contact portions of the 4th and 6th terminals of said first set of terminals; the 3rd and 5th terminals of said second set of terminals are arranged to face toward a rear side of said circuit board so that respective front contact portions of the 3rd and 5th terminals of said second set of terminals are respectively suspending between respective front contact portions of the 4th and 6th terminals of said second set of terminals; and wherein said plastic intermediate bracket comprises four terminal slots arranged in two symmetrical pairs and cut through opposing top and bottom walls thereof; the 3rd and 5th terminals of said first set of terminals and the 3rd and 5th terminals of said second set of terminals are respectively inserted through the terminal slots of said plastic intermediate bracket and electrically bonded to said circuit board.

7. The terminal holder structure as claimed in claim 6, wherein said plastic intermediate bracket is a single piece member.

8. The terminal holder structure as claimed in claim 6, wherein said plastic intermediate bracket is formed of a plurality of sub brackets.

9. A terminal holder structure installed in an electrically insulative housing of a RJ45 dual-port jack, comprising a circuit board, a first set of terminals numbered from 1st through 8th, a second set of terminals numbered from 1st through 8th, at least one first bracket located on said circuit board at a front side and holding the 1st, 2nd, 4th, 6th, 7th and 8th terminals of said first set of terminals in a parallel manner, and at least one second bracket located on said circuit board at a rear side and holding the 1st, 2nd, 4th, 6th, 7th and 8th terminals of said second set of terminals in a parallel manner;

wherein the terminal holder structure further comprises at least one plastic intermediate bracket arranged at a middle part of said circuit board between said at least one first bracket and said at least one second bracket to hold the 3rd and 5th terminals of said first set of terminals and the 3rd and 5th terminals of said second set of terminals in reversed directions so that a distance between the 3rd and 5th terminals of said first set of terminals and the 3rd and 5th terminals of said second set of terminals is extended for crosstalk compensation to avoid crosstalk interference in said RJ45 dual-port jack; and wherein said at least one plastic intermediate bracket comprises four terminal slots arranged in two symmetrical pairs and cut through opposing to and bottom walls thereof; the 3rd and 5th terminals of said first set of terminals and the 3rd and 5th terminals of said second set of terminals are respectively inserted through the terminal slots of said at least one plastic intermediate bracket and electrically bonded to said circuit board.

10. The terminal holder structure as claimed in claim 9, wherein the $3^{rd}$ and $5^{th}$ terminals of said first set of terminals are arranged to face toward a front side of said circuit board so that respective front contact portions of the $3^{rd}$ and $5^{th}$ terminals of said first set of terminals are respectively suspending between respective front contact portions of the $4^{th}$ and $6^{th}$ terminals of said first set of terminals; the $3^{rd}$ and $5^{th}$ terminals of said second set of terminals are arranged to face toward a rear side of said circuit board so that respective front contact portions of the $3^{rd}$ and $5^{th}$ terminals of said second set of terminals are respectively suspending between respective front contact portions of the $4^{th}$ and $6^{th}$ terminals of said second set of terminals.

11. The terminal holder structure as claimed in claim 9, wherein said circuit board comprises four via holes; the $3^{rd}$ and $5^{th}$ terminals of said first set of terminals and the $3^{rd}$ and $5^{th}$ terminals of said second set of terminals have respective rear bonding portions thereof respectively electrically bonded to the via holes of said circuit board.

* * * * *